US005340097A

United States Patent [19]

Yankloski

[11] Patent Number: 5,340,097

[45] Date of Patent: Aug. 23, 1994

[54] AUTOMATIC MAILING MACHINE

[75] Inventor: Richard Yankloski, Webster, N.Y.

[73] Assignee: Data Pac Mailing Systems Corp., Rochester, N.Y.

[21] Appl. No.: 42,372

[22] Filed: Apr. 2, 1993

[51] Int. Cl.[5] ..... B65H 5/00

[52] U.S. Cl. ..... 271/10; 271/11; 271/225; 271/185; 209/584

[58] Field of Search ..... 271/2, 149, 150, 225, 271/184, 185, 104, 105, 107, 4, 5, 10, 11, 273; 209/584, 583

[56] References Cited

U.S. PATENT DOCUMENTS

| | | | |
|---|---|---|---|
| 2,988,355 | 6/1961 | Rabinow et al. | 271/150 X |
| 3,782,541 | 1/1974 | Wood | 209/74 |
| 3,893,392 | 7/1975 | Brenn et al. | 271/5 X |
| 4,488,610 | 12/1984 | Yankloski | 177/4 |
| 4,516,209 | 5/1985 | Scribner | 364/466 |
| 4,688,678 | 8/1987 | Zue et al. | 209/552 |
| 4,778,062 | 10/1988 | Pavie et al. | 209/584 X |
| 4,893,249 | 1/1990 | Silverberg | 364/464.03 |
| 4,923,022 | 5/1990 | Hsieh | 177/4 |
| 4,973,037 | 11/1990 | Holbrook | 271/2 |
| 5,147,048 | 9/1992 | Signoretto | 209/698 |
| 5,163,669 | 11/1992 | Hurd et al. | 271/125 |
| 5,174,454 | 12/1992 | Parkander | 209/583 X |
| 5,191,196 | 3/1993 | Mercede | 235/484 |

*Primary Examiner*—David H. Bollinger
*Attorney, Agent, or Firm*—M. LuKacher

[57] ABSTRACT

A mailing machine includes a mail transport device for vertically moving individual pieces of mail from a mail bundle to an apparatus for weighing such pieces of mail and to then move same to a further station where each piece of mail is positioned horizontally by a plurality of rotating members while a bar code is printed thereon, if desired. After such positioning, the piece of mail is transported in one of two directions dependent upon previously selected criteria pertinent to the piece of mail. One direction moves the mail piece to a bulk mailing apparatus disposed adjacent the mailing machine while moving the mail piece in the other direction delivers it to an apparatus coupled to the mailing machine for sorting and storing each piece of mail, again dependent upon information pertinent to the particular piece of mail. The sorting and storing apparatus includes mechanism for selecting the mail piece and for simultaneously moving same in the X-and Y-directions and for then moving that mail piece in the Z-direction to an appropriate mail storage space. The mailing machine is configured to occupy a much smaller space than conventional mailing machines.

23 Claims, 7 Drawing Sheets

AUTOMATIC MAILING MACHINE

BACKGROUND OF THE INVENTION

The present invention relates to a mailing apparatus, and particularly to a mailing machine capable of handling items of mail in envelopes of different sizes and shapes, without adjustment, and which automatically discerns mail in envelopes of varying size, weights the mail items individually, applies appropriate bar codes,if desired, to each item and then transfers each item to either a bulk mailing station or to a further station where each item is dispensed automatically to a receptacle designated for the particular zip code previously applied to the item, and especially which can be configured to occupy little space so as to provide a compact mailing machine. The term "letter" as used herein should be taken generally to mean an item or piece of mail.

In the past, machines such as the above have been rather large and occupy a substantial amount of floor space, or, if the individual mailing functions have not been combined into one apparatus, the individual pieces will be remotely located from each other making the procedure of processing mail less efficient, more time consuming and, accordingly, more costly to process mail.

Examples of previously known mail processing devices, or similar devices are shown in U.S. Pat. No. 3,782,541 entitled "Apparatus for Transferring Stacks of Mail or Like Articles", issued Jan. 1, 1974; U.S. Pat. No. 4,488,610 entitled "Sorting Apparatus", issued Dec. 18, 1984; U.S. Pat. No. 4,516,209 entitled "Postage Metering System Having Weight Checking Capacity", issued May 7, 1985; U.S. Pat. No. 4,688,678 entitled "Sorter Apparatus for Transporting Articles to Releasing Locations" issued Aug. 25, 1987; U.S. Pat. No. 4,893,249 entitled "Mailing Machine", issued May 8, 1990; U.S. Pat. No. 4,923,022 entitled "Automatic Mailing Apparatus" issued May 8, 1990; U.S. Pat. No. 5,147,048 entitled "Sorting Line for Processing Envelopes, Particularly for Photographic Laboratories", issued Sep. 15, 1992; U.S. Pat. No. 5,163,669 entitled "Paper Feed Mechanism Having an Adjustable Restrainer", issued Nov. 17, 1992; U.S. Pat. No. 4,973,037 entitled "Front End Feeder for Mail Handling Machine", issued Nov. 27, 1990 and U.S. Pat. No. 5,191,196 entitled "Apparatus for Adjustably Securing a Bar Code Scanner Device Using Nylon Hook and Loop Type Fasteners" issued Mar. 2, 1993.

SUMMARY OF THE INVENTION

The present invention is therefore directed toward a mailing machine which occupies a minimal amount of floor space and which automatically processes mail for bulk mailings, or handles individual mail items, pieces of varying sizes, shapes and weights without adjustment and which may be utilized to apply appropriate bar codes to individual pieces of mail and to then sort and direct those pieces or of mail to appropriate zip code stations.

Briefly, in accordance with one feature of the present invention, a mailing machine is provided having a first station for holding letters, which may be of varying size and weight; a second station for receiving a single letter from the first station and, if required, weighing such letter; a third station for applying a bar code to the letter, should such be required, and then propelling the letter to a fourth station where the letter is transferred to either a bulk mailing machine or to a zip code sorting apparatus. The stations are located so that each piece of mail can be processed and handled regardless of its shape and size thereby avoiding the need for continual adjustment either by an operator or sensing and adjustment mechanism.

The mailing machine may include a further station for collecting each piece of mail and then automatically transporting it to an appropriate storage space designated for the zip code applied to the letter.

The mailing machine may further include apparatus in communication with the zip code sorting and storing apparatus for determining when a storage space for any zip code is full.

DETAILED DESCRIPTION OF THE PREFERRED EMBODIMENT

1) Relationship of Parts

Figure 1:
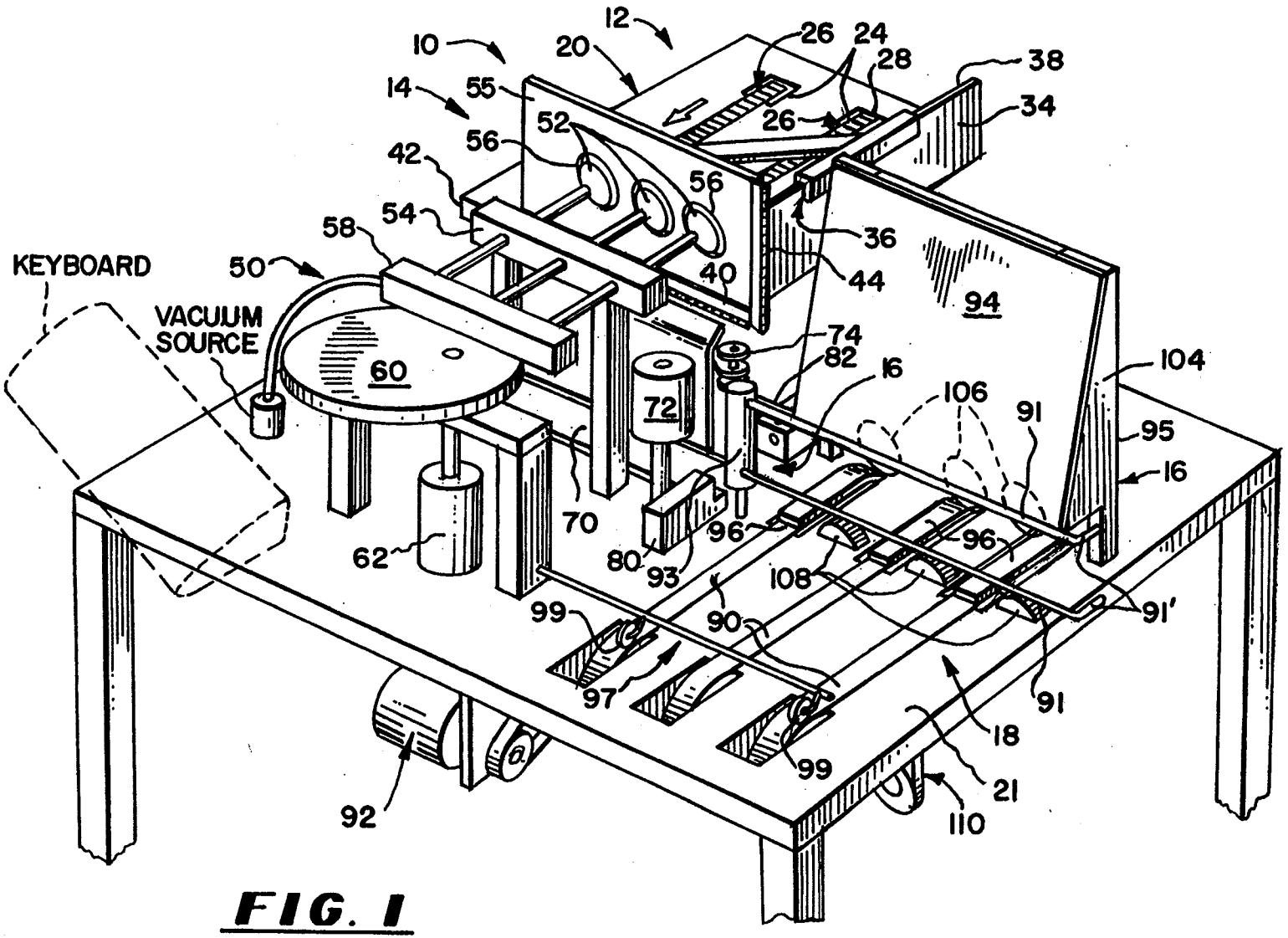
FIG. 1 is a perspective view of the automatic mailing machine according to the present invention.

As illustrated in FIG. 1, the automatic mailing machine 10 of the present invention generally includes 1) a first letter stacking and transport station 12 for receiving and supporting a stack of letters which may be of various sizes and weights; 2) a second station 14 for transferring an individual letter from the first station to a weighing machine; 3) a third station 16 for applying designated bar codes to each individual piece of mail (should such be desired) and for ejecting them thereafter to a 4) fourth station 18 for directing each piece of mail to either a bulk mailing machine or to a zip code sorting apparatus.

Figure 2:
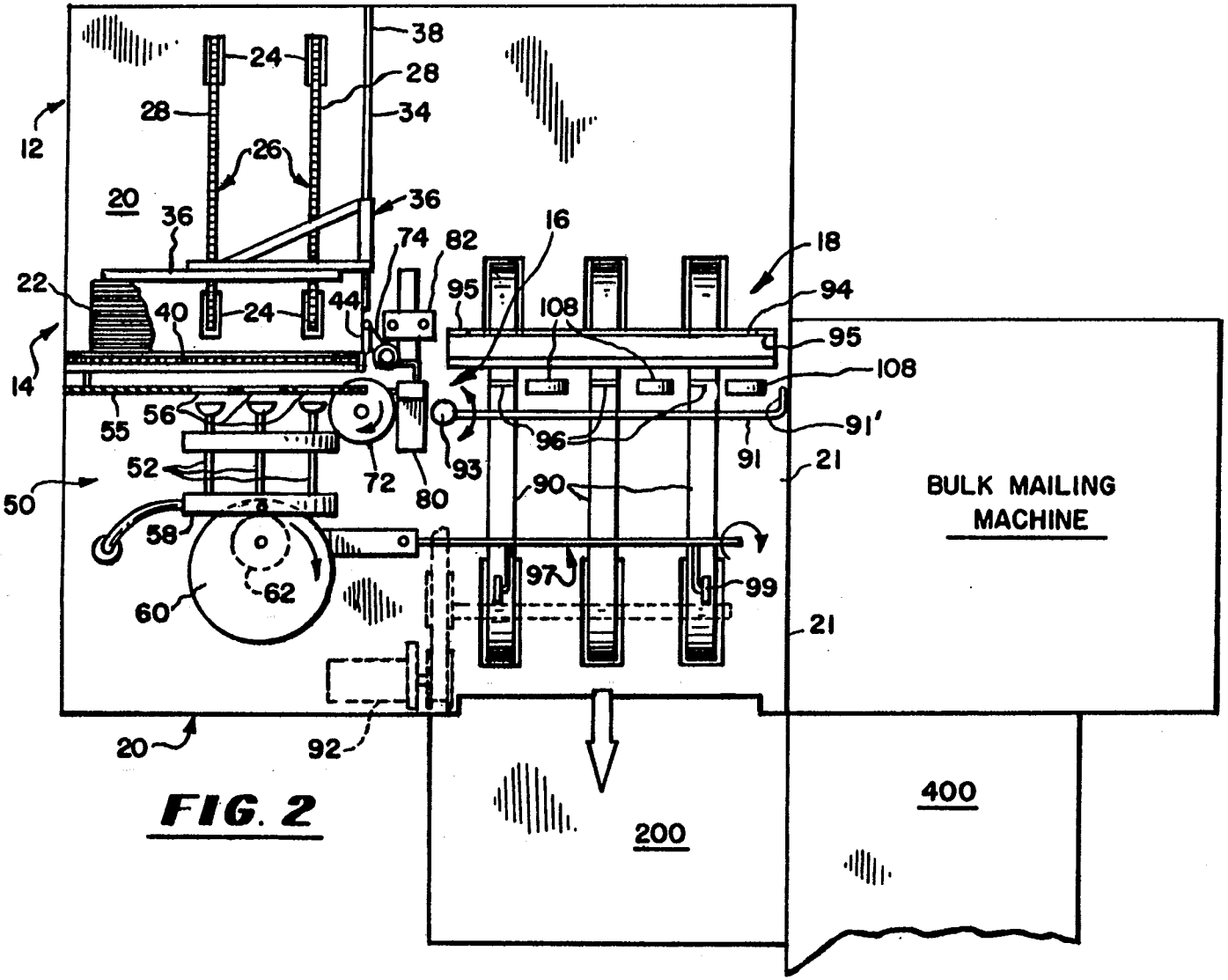
FIG. 2 is a top plan view of the automatic mailing machine shown in FIG. 1.
Figure 3:
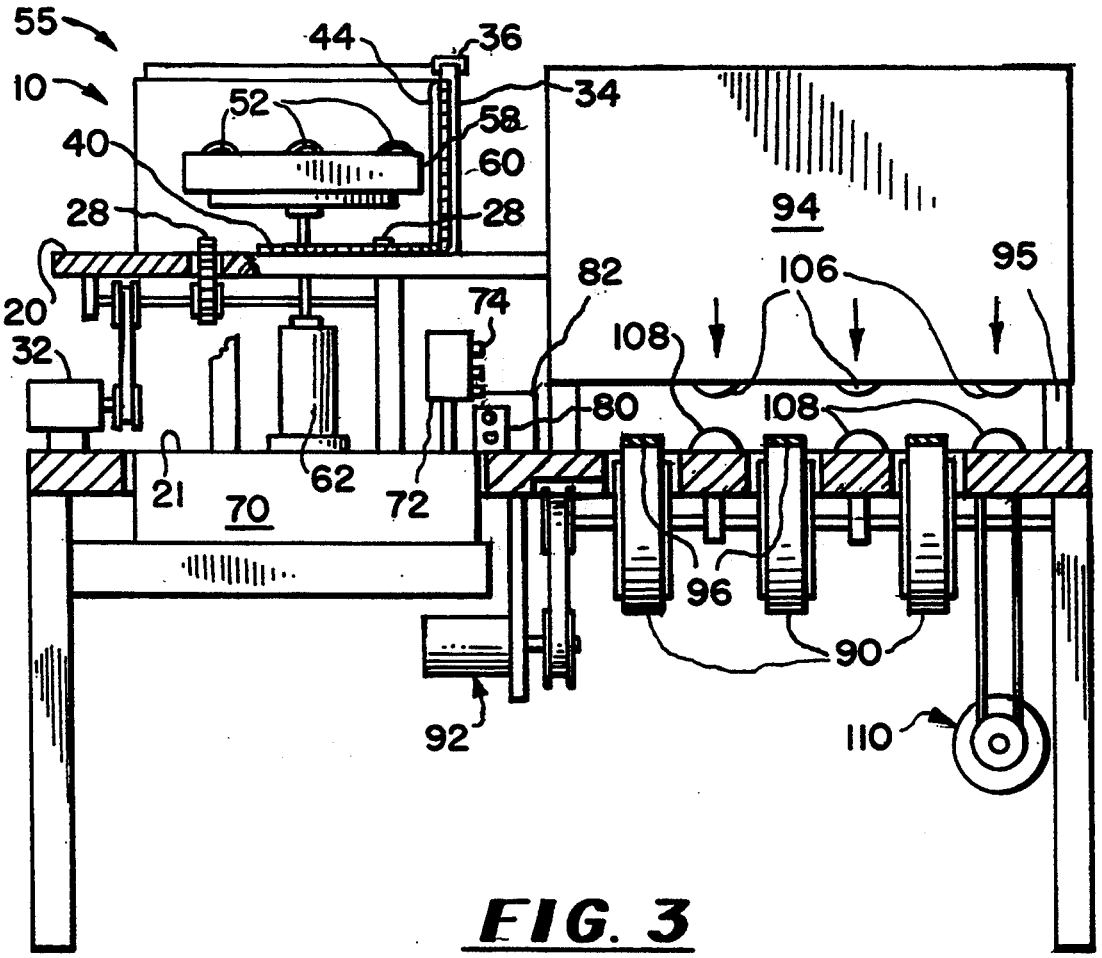
FIG. 3 is a front view thereof.

The first letter stacking and transport station 12 comprises a two tier table 20, 21 on the upper tier 20 of which a stack of letters 22, as best illustrated in FIG. 2, is disposed. The table 20 has a plurality of slots 24 formed therein so as to be generally perpendicular to the stack of letters 22. A chain and sprocket assembly 26 is disposed in each of the slots so that the chain 28 is elevated slightly above the table 20. The sprocket 30 is connected to an appropriate drive motor 32, as seen in FIG. 3, which is energized to cause rotation of the sprockets and, therefore, translation of the drive chains 28 along surface of the table 20.

A guide rail 34 is mounted perpendicularly to the table 20 generally adjacent the edge of the stack of letters 22. A pressure plate 36 is slidably mounted to the guide rail 34 along the rail's top edge 38 while the bottom of the bar is received and supported by the plurality of chains such that movement of the chains imparts a likewise movement of the pressure plate 36. The pressure plate 36 which is driven by the chains, exerts a constant and even pressure against the stack of letters 22 toward a horizontal plate 40 which is pivotable mounted generally toward the front edge 42 of table 20 and against which the first letter in the letter stack 22 bears. A further plate 44 is pivotally mounted vertically to the table 20 in juxtaposition to horizontal plate 40 and adjacent the edge of the letter stack 22.

A vacuum pickup mechanism 50 is mounted to table 20 and comprises a plurality of suction devices 52 supported above the table by way of support fixture 54 for horizontal reciprocating movement toward and away from a horizontal plate 55 which is fixed in position just forward of the hinged plates 40 and 44. Plate 55 includes a series of apertures 56 equal to the number of suction devices 52 and in alignment therewith. Each of the suction devices 52 is secured at the end opposite the suction end to a vacuum manifold 58 which, in turn, is pivotally affixed to a cam member 60 rotatably driven by way of motor 62.

A weigh scale 70 is mounted to table 20 adjacent and generally below the letter stack 22. A rotatable letter transport wheel 72 is mounted to the table 20 immediately adjacent the weigh scale 70. A pivoting kicker wheel 74 is also mounted to table 20 so as to be in close relationship to transport wheel 72.

A bar code print head 80 and bar code pressure plate 82 are disposed on table 20 so as to be immediately adjacent the letter transport wheel 72 and the kicker wheel 74. The bar code pressure plate 82 is movable toward and away from the print head 80.

Figure 4:
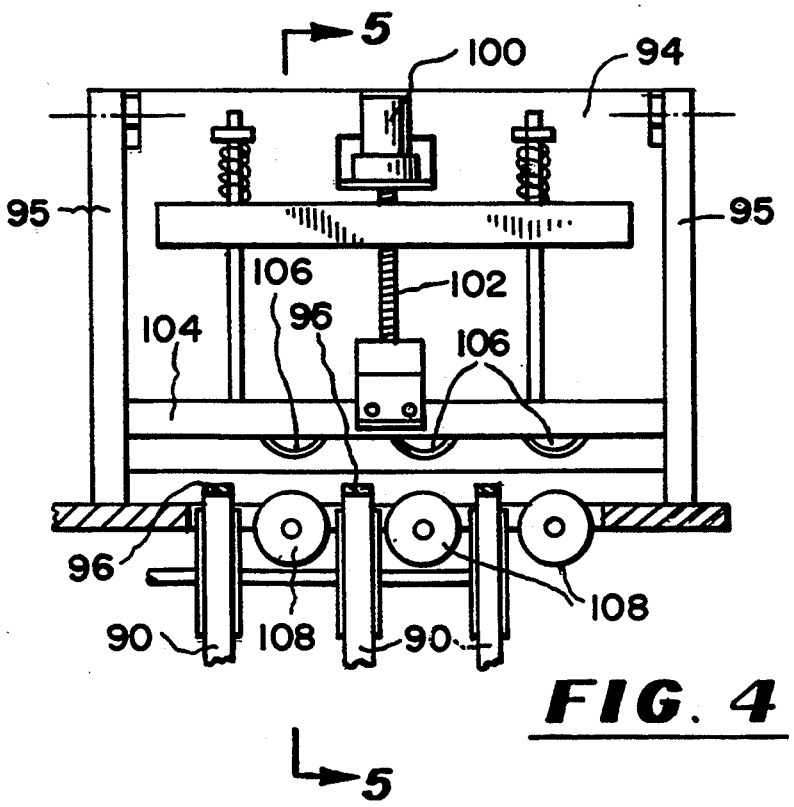
FIG. 4 is a rear view of the support and letter transfer bar.
Figure 5:
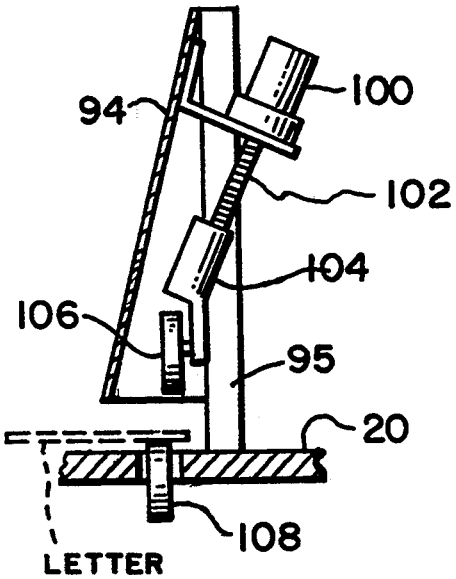
FIG. 5 is a sectional view taken along line 5—5 of FIG. 4 showing the roller wheels of support and letter transfer bar; in a retracted position.
Figure 6:
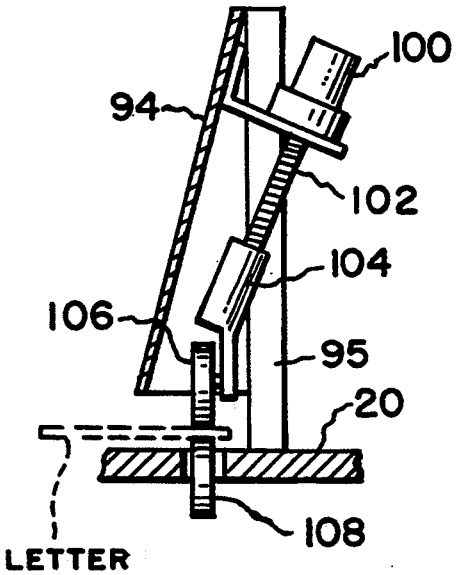
FIG. 6 shows the roller wheels of FIG. 4 in position directly over a letter supported by the transport belts.

A plurality of end less transport belts 90 are affixed to an appropriate pulley/motor assembly 92 so as to protrude through table 21 in a direction generally parallel to that of the chain and sprocket assembly 26. A plate 94 is vertically mounted to the table 21 by vertical mounts 95 so as to straddle the transport belts 90 and to be generally opposite the weigh scale 70, kicker wheel 74, bar code print head 80, etc. A motor 100, as best seen in FIG. 4, is secured to the plate 94 and includes a lead screw 102 coupled to an angular member 104 to which a series of rollers 106 is mounted. The lead screw 102 is threadably received by plate 94 such that rotation of the screw 102 causes the member 104 to translate therealong as best seen in FIGS. 5 and 6. A number of ejection wheels 108 are rotatably mounted to table 21 between the transport belts 90 and perpendicular thereto. The ejection wheels are coupled to an appropriate motor/pulley system 110, as best seen in FIG. 3.

As best illustrated in FIG. 2, an apparatus 200 for transporting and storing individual pieces of mail mounts to the front of the table 20 adjacent the transport belts 90. As further detailed in FIGS. 7–9, apparatus 200 includes a letter pickup assembly 202, a transport device 300 for shifting letters simultaneously in the X-, Y-and Z-directions and a storage rack 400 consisting of a plurality of storage cavities each of which corresponds to a specific zip code number.

Letter pickup assembly 202 includes a plate 204 mounted generally horizontal to table 21 and a motorized tractor belt assembly 206 which is mounted to plate 204 so as to be pivotable from a first position parallel to, and touching or nearly touching the surface of the plate, to a second position away from the plate's surface. The tractor belt assembly 206 comprises a flexible drive belt 208 mounted between a complimentary pair of pulleys 210 which are rotatably secured to a vertical support 212 fixed to plate 204. One of the pulleys 210 is connected via a drive axle 211 to an appropriate motor 214 which is pivotally mounted to the plate 204 by yoke 216. A crank and pin mechanism 218, as best illustrated in FIG. 7, is activated by a solenoid 220 to cause the letter pickup assembly 202 to pivot thereby rotating the tractor belt 208 toward or away from the surface of plate 204.

Figure 7:
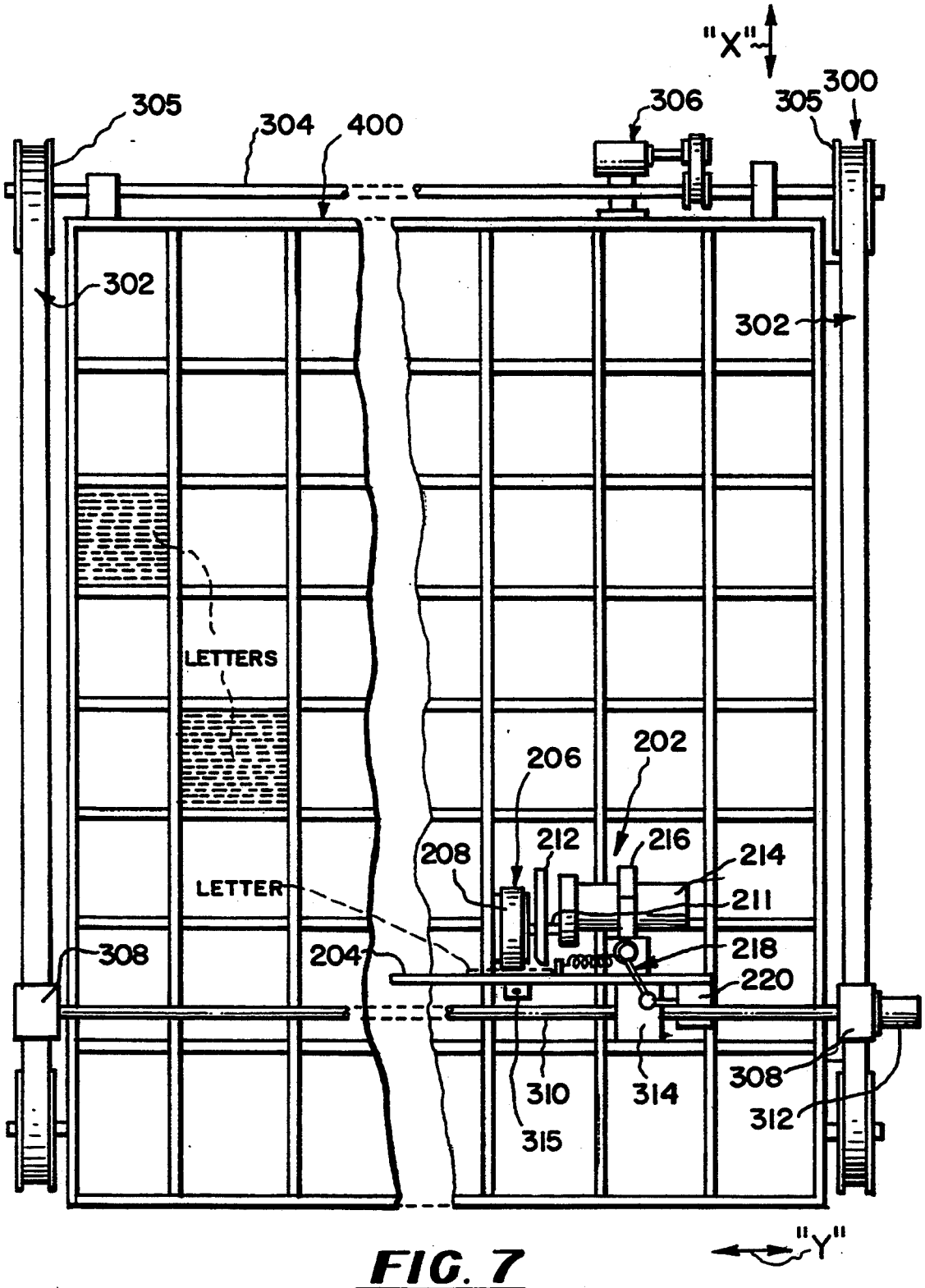
FIG. 7 is a front view of the zip code transport and storing apparatus.
Figure 8:
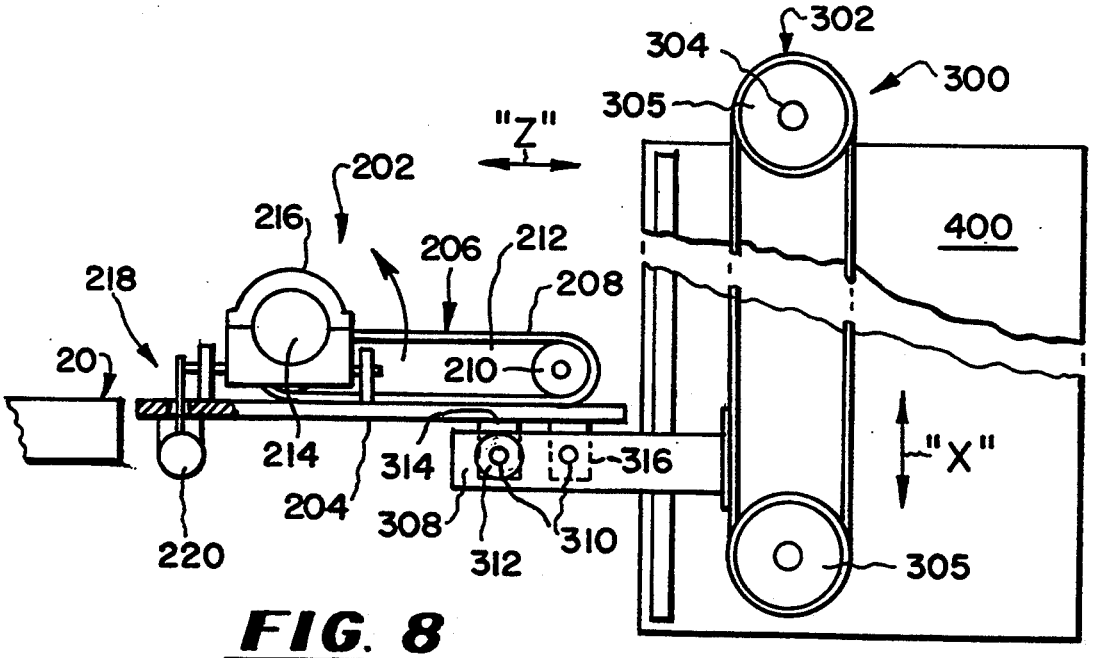
FIG. 8 is a side view of the apparatus shown in FIG. 7.
Figure 9:
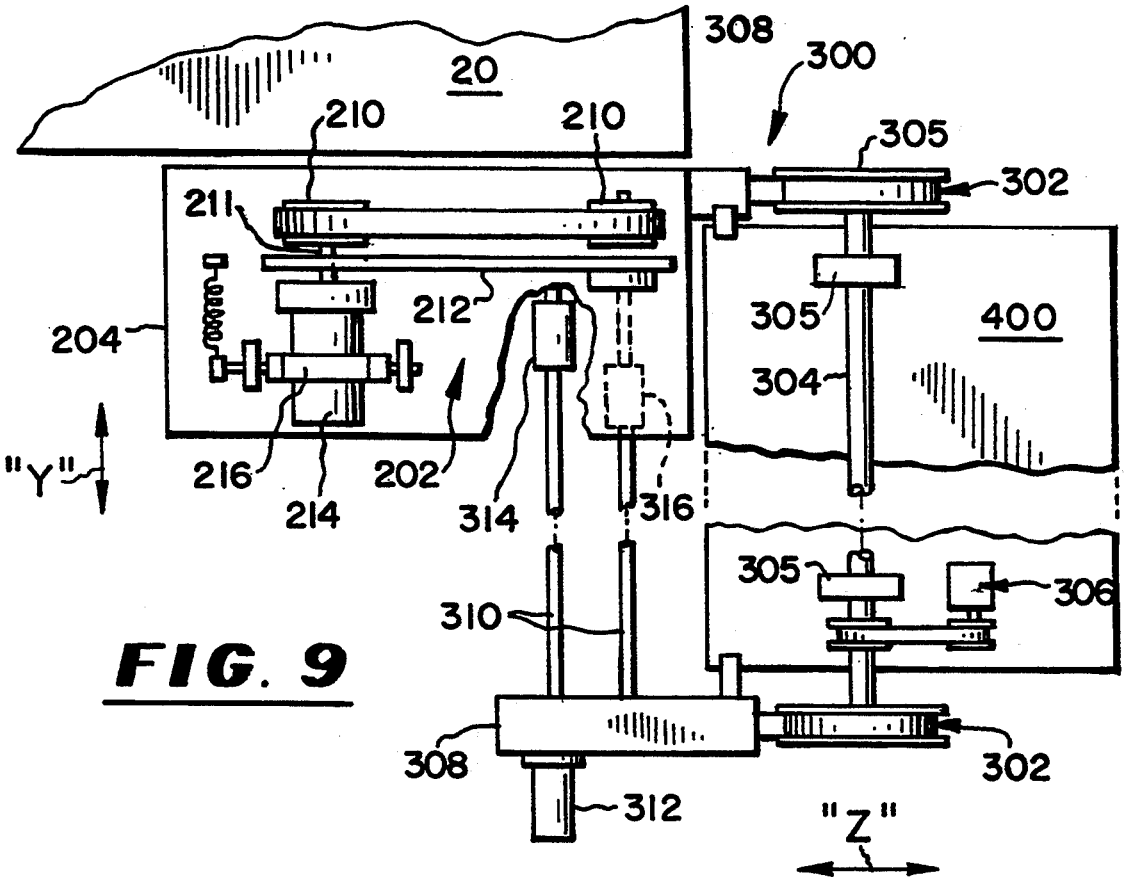
FIG. 9 is a top view of the apparatus shown in FIGS. 7 and 8.

As best depicted in FIGS. 7–9, transport device 300 includes a pair of pulley and belt assemblies 302 mounted to opposite sides of storage rack 400. A common axle 304 journalled to the top of storage rack 400 connects together the upper pairs of pulleys 305 of the pulley and belt assemblies 302. Axle 304 is rotated by any appropriate mechanism, such as by a pulley, belt and motor assembly 306. A support plate 308 is affixed to each belt of the pulley and belt assembly 302 so as to extend perpendicularly therefrom, as shown in FIG. 8. A pair of linear guide and transport rods 310 are mounted to and extend between the support plates 308 and are aligned with and parallel to each other. One of the rods is rotated by an electric motor 312 which is affixed to one of the support plates 308. The other rod is simply fixed therebetween. A linear clutch 314 is journalled to the rotatable rod 312 and secured to the bottom of plate 204. A bearing 316 is journalled about the fixed rod and is secured to the bottom of plate 204. As is best seen in FIGS. 7 and 8, the letter pickup assembly 202 mounts perpendicular and parallel to the front of storage rack 400.

2) Operation of the Apparatus

The following description sets forth the operation of the automatic mailing machine.

A mail bundle 22, which may comprise letters of different sizes, shapes and weights is stacked vertically upon table 20 between the pressure bar 36 and the hinged horizontal and vertical plates 40 and 44 respectively, as best seen in FIG. 2. Upon activation of the apparatus, the chain and sprocket assembly 26 begins rotating and the chains 28 which carry the mail stack 22 begin translating along the table's surface. The first letter of the letter stack 22 is forced by the movement of the chains 28 against the hinged horizontal and vertical plates 40 and 44, respectively. As sufficient force is exerted against the plates, they are caused to pivot to an "open" position and simultaneously, by use of a common switch (such as a micro switch, not shown here), the motor 62 of vacuum pickup mechanism 50 is energized which, in turn, rotates the cam 60. The suction devices 52 carried by cam 60 are translated toward the vertical plate 55 and through a series of apertures 55 formed therein to engage the first letter in the letter stack 22. Vacuum is applied to the suction devices 52 and as the cam 60 continues to rotate, the letter is pulled from the stack and positioned over the weigh scale 70. An appropriate sensor, such as a micro switch, detects the position of the letter over the scale and signals the vacuum pickup mechanism 50 to release the letter thereby dropping it onto the weigh scale 70. The horizontal and vertical plates 40 and 44, respectively, are then pivoted back to their "closed" position so as to engage the next letter in the letter stack 22 and repeat the process. That is, plates 40 and 44 act as gates which pivot back and forth with respect to each other.

Once the letter is deposited upon the weigh scale, it is accurately weighed and, in a well known manner, the information is processed to assure that particular letter is assigned the exact postage due. Of course, in some instances, such as when the exact weight of the letter is already known, the letter would be automatically sent to the bulk mailing apparatus for further processing and this step would be eliminated. However, if this is not the case, at this particular time, an appropriate bar code may be imprinted on the face of the letter. Generally, this would be accomplished by an operator inputting information pertinent to the specific letter through the use of a computer console conveniently positioned with respect to the automatic mailing machine 10 and shown in dotted lines in FIG. 1. The print head pressure plate 82 is energized and moves in a direction toward the bar code print head 80 thereby pressing the letter between the two to enable the bar code to be applied to the letter. The bar code print head 80 is coupled electronically to the letter transport wheel 72 by an appropriate shaft encoder (not shown) such that the resolution of the bar code imprinted on the letter is dependent upon the speed at which the letter is moved along its path. In this instance, the bar code print head has a resolution of 50 dots per inch (50 DPI) which matches the speed of the migrating letter. Once this task is accomplished, the bar code pressure plate 82 retracts to its rest position and the letter is then engaged on one side by the letter kicker wheel 74 which forces it into engagement with the letter transport wheel 72 which is being rotated at a specific speed, which as just referenced, matches the speed at which the bar code print head applies the bar code to the letter. After the code is applied, the continued rotation of the transport wheel 72 causes the letter to be ejected from the weigh scale/bar code areas over the transport belts 90 to rest vertically against the plate 94. As best illustrated in FIGS. 1 and 2, a pair of stopper rods 91 may be utilized to catch and stop the letter as it is ejected from the weigh scale 70 by way of hooked ends 91'. The stopper rods 91 may be mounted to an appropriate fixture 93 which is spring-biased for rotation about its own axis. The stopper rods 91 may also be mounted to fixture 93 so that they themselves may be rotated to move the hooked ends 91' to a position such that the letters are not engaged.

There, dependent upon what step is to take place next, the letter is further processed. If, for example, the letters are to be sent to a bulk mailing machine, such as are available from Ascom Hasler, Pitney Bowes or Friden, the letters are first translated from their vertical position against the plate 94 to a horizontal position over the table 20 and transport belts 90. This is accomplished by activating the motor which drives the transport belts 90 in the direction toward the front edge of the table. Each of the belts includes a raised cog 96 (provided by a belt section which may be laminated to the endless transport belts 90) which, upon rotation of the belt, engages the lower edge of the letter thereby causing the letter to fall from its vertical position to a horizontal position over the table 20 and belts 90. Thereafter, the direction of the belts 90 is reversed and the raised cog 96 comes into contact with the bottom edge of the letter forcing it back into engagement against mounts 95 of the hinged support plate 94. As the letter is being registered, motor 100 is energized causing rotation of lead screw 102 and the downward movement of the elongated member 104 and rollers 106 angularly disposed thereon as best illustrated in FIGS. 5 and 6. The letter is thereby captured between rollers 106 and a complimenting set of rollers, or ejection wheels, 108 which are mounted to the table 20 between the transport belts 90. The wheels 108 are caused to rotate by means of a motor/pulley system 110, best illustrated in FIG. 3. Similar to the system just described, the letter is pinched between the wheels 108 and rollers 106 and thereby caused to be ejected off the table 20 and into the bulk mailing machine, as shown in FIG. 2.

However, in some instances it may be desirable to move the letter to a predetermined storage space, such as, for example, one designated for specific and unique zip codes. In this instance, the letter once it is positioned horizontally on the table 20 over the transport belts 90 and the rollers 106 are retracted, the motor/pulley system 92 is activated thereby rotating transport belts 90. The letter is engaged by raised cog 96 which moves it to the edge of the table 20 and onto plate 204 of letter pickup assembly 202. In some instances, it may be desirable to provide a pinch roller mechanism 97, as best seen in FIGS. 1 and 2 to ensure that the letter is properly transported from the belts 90 to the pickup assembly 202. The pinch roller mechanism 97, which is rotatable, and may be spring biased, assists in this function by way of its rollers 99 which engage the letter at the end of the belts travel. The motorized tractor belt assembly 206 is rotated from its retracted "up" position by activating solenoid 220 which detects the position of the letter and in turn drives crank and pin mechanism 218 causing belt assembly 206 to engage the letter. Once the letter is pinched by belt assembly 206 against plate 204, transport device 300 is activated. Support plates 308 which are fixed to pulley and belt assembly 302, are in turn driven in the X-direction, as indicated in FIGS. 7 and 8. Simultaneously, motor 312 is energized thereby rotating linear guide rod 310 causing linear clutch 313 to translate in the desired Y-direction therealong. As letter pickup assembly 202 is coupled to linear clutch 313, it too is translated in the Y-direction.

Accordingly, as best seen in FIG. 7 the letter pickup assembly 202 is driven in the X-and Y-directions until the assembly is positioned exactly in front of a specific storage space located in storage rack 400 based upon information input from the previously referenced computer operator relative to the particular letter disposed on the assembly 202. Once that position has been achieved, tractor belt assembly 206 is energized causing drive belt 208 to eject the letter in the Z-direction (as shown in FIGS. 8 and 9) into the desired and correct storage space in storage rack 400. However, in the instance where the particular storage space is full as illustrated in FIG. 7 and cannot accept any further mail, a photocell 315 mounted to plate 204 detects this condition and sends a signal to the computer which, in turn stops further operation of the device and advises the operator that a full condition exists. The operator can then clear the particular space and reactivate the apparatus. The letter pickup assembly 202 is then returned to its position against the front edge of table 20, ready to receive and transport the next letter to a storage space which corresponds to its pre-assigned zip code designation.

Figure 10:
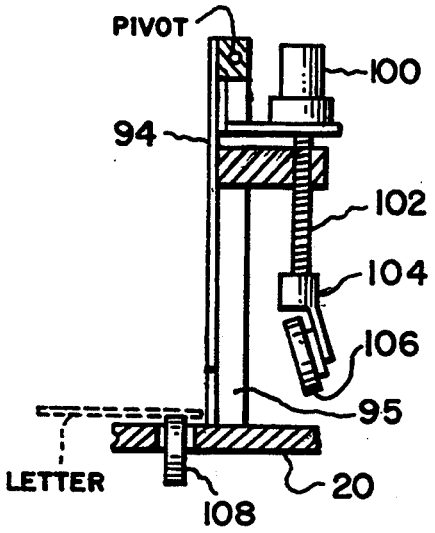
FIGS. 10 and 11 are variations of the apparatus shown in FIGS. 5 and 6.
Figure 11:
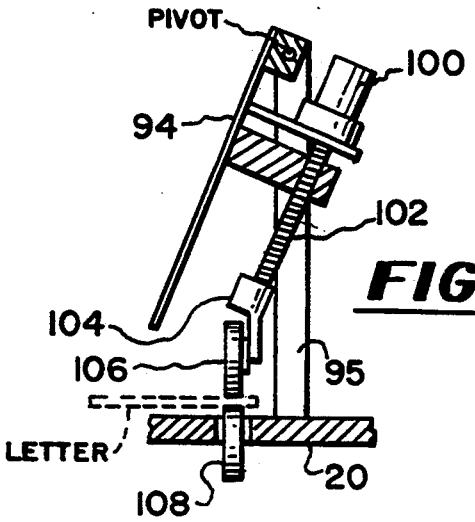

In a further embodiment of the invention as shown in FIGS. 8 and 9, it may be desirable to pivotally mount plate 94 and roller wheels 106 supported thereon to vertical mounts 95 so as to be rotatable from a first rest position shown in FIG. 10 to a second position shown in FIG. 11 over and above the ejection wheels 108. This is accomplished by providing a simple electric motor (not shown) which when activated rotates plate 94 from the first position to the second position, and back. The roller wheels 106, would, of course, appropriately be mounted so that when they are rotated over the ejection wheels 108 they are essentially in parallel alignment with each other.

While the invention has been disclosed and described with reference to a limited number of embodiments, it is apparent that other variations and modifications may be made thereto, and therefore it is intended that the following claims cover such variations and modifications without departing from the spirit and scope of the invention.

I claim:

1. A mailing machine for automatic processing of pieces of mail of varying sizes, shapes and weights supplied from a mail bundle, comprising:

a. first means for receiving and vertically supporting mail bundle above a horizontal surface defined on said first means, said first means including transport means for engaging and incrementally moving said bundle along said horizontal surface defined on said first means;

b. second means for engaging and transferring individual pieces of mail vertically from said bundle to an apparatus for weighing said individual pieces of mail;

c. third means for weighing individual pieces of mail received from said second means; and d. fourth means for moving said individual pieces of mail from said mail weighing means after weighing thereof to apparatus for selectively directing said pieces of mail to a further mail handling apparatus; said moving means including means for transferring said mail piece from a vertical position to a horizontal position and means for transporting said mail piece once horizontally positioned to either said bulk mailer or to said sorting and storing apparatus.

2. The mailing machine as set forth in claim 1 wherein said first means includes a plurality of chain members; means for moving said chain members along said horizontal surface and a guide bar for engagement with said mail bundle and said chain members for movement of said mail bundle in response to movement of said chains.

3. The mailing machine as set forth in claim 1 wherein said second means for engaging and transferring individual pieces of mail comprises:

a. a cam member;

b. a plurality of suction devices pivotally secured to said cam member and connected to a source of vacuum; said suction devices being reciprocally translatable by said cam member from a first position away from said mail bundle to a second position in engagement with the first piece of mail in said bundle and for picking said first piece therefrom thereby moving said individual pieces of mail from said mail bundle; and c. gating apparatus mounted to said mail machine in juxtaposition to said suction devices and in direct contact with said first piece of mail in said mail bundle for detecting movement of individual pieces of mail from said mail bundle by said suction devices and for releasing vacuum therefrom as said suction devices attain the second position thereby dropping said mail piece onto to said mail weighing means for further processing.

4. The mailing machine as set forth in claim 3 wherein said gating apparatus comprises a plurality of hinged members connected to said compact mailing machine adjacent said first means, said hinged members being pivotal from a first position to a second position in response to movement of said first piece of mail from said mail bundle.

5. The mailing machine as set forth in claim 4 wherein said plurality of hinged members comprise a vertical gate for engaging the vertical edge of said mail bundle and a horizontal gate for engaging the horizontal edge thereof, said gates cooperating together to restrain said mail bundle in said first position and to allow an individual piece of mail to pass thereacross when in the second position.

6. The mailing machine as set forth in claim 1 wherein said fourth means comprises:

a. a rotating transport wheel for contact with said individual piece of mail on said mail weighing means and a pivoting kicker wheel mounted adjacent thereto, said kicker wheel being pivotal toward and away from said transport wheel so as to engage said mail piece therebetween and to cause said mail piece to be ejected toward said means for transferring said mail from a vertical position to a horizontal position;

b. a support member vertically disposed on said mailing machine immediately adjacent said weighing means, said support member having an angled surface defined thereon for engagement with a horizontal surface of said mail piece as said mail piece is ejected from said weighing means; and c. a plurality of belt members rotatably mounted to said mailing machine horizontally below said angular support member, said belt members being disposed so as to engage and support a horizontal edge of said mail piece, said belt members including means thereon for contacting a horizontal surface of said mail piece as said belt members are being rotated thereby causing said mail piece to be moved from a vertical position to horizontal position over said belt members whereby said mail piece may be transferred by said belts to said sorting and storing apparatus.

7. The mailing machine as set forth in claim 6 wherein said support member having an angular surface defined thereon includes roller means for reciprocating movement toward or away from said mail piece disposed horizontally on said belt members, said roller means being in substantial alignment with and in close juxtaposition to a corresponding set of energizable rollers supported by said mailing machine when said rollers on said support member have reached the full extent of their travel toward said support member rollers whereby said mail piece when pinched between said opposing rollers is caused to be ejected in the direction of rotation of said energizable rollers upon activation thereof.

8. The mailing machine as set forth in claim 7 wherein said roller means disposed on said support member includes a plurality of rollers carried by a member journalled to said support member and said member is coupled to a rotatable screw mechanism which upon activation drives said member and said plurality of rollers up or down said support member.

9. The mailing machine as set forth in claim 6 wherein said contacting means on said plurality of belt members comprises a raised cog member formed thereon for engagement with said mail piece supported on said belt members, said raised cog assisting in moving said mail piece from a vertical position to a horizontal position by positive engagement with said piece as said belt members are translated, without adjustment of said contact means to engage said mail piece regardless of the shape, size and weight thereof.

10. The mailing machine as set forth in claim 6 wherein the surface on said support member for engagement with a horizontal surface of said mail piece is substantially horizontal and said support member is pivotally secured to said machine so as to be pivotal back and forth from a first position wherein said surface is horizontal to a further position wherein said surface is angularly disposed with respect to said table.

11. The mailing machine as set forth in claim 6 and further including means thereon for catching said mail piece as said mail piece is ejected by said rotating transport wheel and said pivoting kicker wheel and assuring said mail piece is relatively positioned at said support member vertically disposed on said mailing machine.

12. The mailing machine as set forth in claim 11 wherein said means for catching said mail piece includes at least one stop rod having a hooked portion formed thereon for engagement with said mail piece as said mail piece is ejected.

13. The mailing machine as set forth in claim 12 wherein said at least one stop rod is pivotal about its own axis so as to movable away from engagement with said mail piece as said mail piece is ejected.

14. The mailing machine as set forth in claim 13 wherein said stop rod is mounted to a fixture which is pivotally mounted to said machine, said pivotal fixture being pivotal toward or away from said support member.

15. The mailing machine as set forth in claim 14 wherein said pivotal fixture incorporates a spring biasing mechanism such that said fixture is held in a first position normal to said support member.

16. The mailing machine as set forth in claim 1 and further including apparatus for sorting and storing individual pieces of mail after processing thereof by said compact mailing machine which comprises said further mail handling apparatus.

17. The mailing machine as set forth in claim 16 wherein said apparatus for sorting and storing mail pieces a. a multi-compartmented storage rack detachably mounted to said mailing machine adjacent said fourth means;

b. a letter pickup device for engaging and removing said mail piece from said mailing machine as said mail piece is moved by said fourth means;

c. apparatus mounted to said storage rack and having said letter pickup device mounted thereon for providing movement in the X-and Y-directions with respect to said storage rack dependent upon information received pertinent to said individual piece of mail being processed and sorted; and d. means disposed on said letter pickup device and cooperative therewith for moving said individual piece of mail being processed in the Z-direction toward said storage rack and into a predetermined compartment in said storage rack dependent upon information received pertinent to said piece of mail being processed.

18. The mailing machine as set forth in claim 17 wherein said means disposed on said letter pickup device for moving mail pieces in the Z-direction comprises a pivotal tractor belt assembly mounted to a plate member which is mounted to said apparatus for providing movement in the X- and Y-directions, said tractor belt assembly being pivotal to a first open position to permit said piece of mail being processed to be positioned between said assembly and said plate member and thereafter pivotal to a second closed to capture said mail piece therebetween, said tractor belt assembly being energizable as said apparatus for providing movement in the X- and Y-directions reaches a predetermined reference location whereby said mail piece is ejected into an appropriate compartment in said multi-compartment storage rack.

19. The mailing machine as set forth in claim 18 wherein said apparatus for providing X- and Y- directional movement comprises:

a. a belt and pulley system mounted to said multi-compartment storage rack such that activation thereof provides movement of the belt and pulley system in the X-direction with respect to said rack; and b. apparatus mounted to said belt and pulley system for providing cooperative movement in the Y-direction as said belt and pulley system is moving in the X-direction.

20. The mailing machine as set forth in claim 19 wherein said belt and pulley system comprises pairs of upper and lower pulleys mounted to opposite sides of said storage rack, said pulleys having belts cooperatively mounted thereto, and said upper pairs of pulleys being rotatably joined together by a common shaft so as to provide rotation of the belts carried thereby as said shaft is rotated.

21. The mailing machine as set forth in claim 19 wherein said apparatus for providing movement in the Y-direction comprises means coupled between said belts for cooperative movement therewith as said belts are rotated and said apparatus mounting said letter pickup device being affixed to said means coupling said belts for simultaneous movement therewith.

22. The mailing machine as set forth in claim 21 wherein said means coupled between said belts comprises a pair of shafts one of which is fixed and the other being rotatable, said fixed shaft being joined to said plate member by a bearing and said rotatable shaft being joined thereto by a linear clutch whereby rotation of said shaft causes said linear clutch, and said plate member, to migrate along said rotatable shaft in the direction of rotation.

23. A mailing machine for automatic processing of mail supplied from a mail bundle, comprising:

a. first means for receiving and vertically supporting a mail bundle above a horizontal surface defined on said first means, said first means including transport means for engaging and incrementally moving said bundle along said horizontal surface;

b. second means for engaging and transferring individual pieces of mail vertically from said bundle to an apparatus for weighing said individual piece of mail;

c. third means for weighing individual pieces of mail received from said second means;

d. fourth means for moving said individual pieces of mail from said mail weighing means after weighing thereof to apparatus for selectively directing said mail pieces to; 1) a machine for bulk processing of mail, or 2) an apparatus for sorting and storing such mail dependent upon information received pertinent to the mail piece being sorted and stored, said moving means including means for transferring said mail piece from a vertical position to a horizontal position and means for transporting said mail piece once horizontally positioned to either said bulk mailer or said sorting and storing apparatus; and e. fifth means coupled to said fourth means for applying bar code indicia to said individual mail piece as said mail piece is being moved from said mail weighing means to said apparatus for selectively directing said mail piece to either said bulk mail processing machine or said mail sorting and storing apparatus.

* * * * *